US009322612B2

(12) United States Patent
Clifton, Jr.

(10) Patent No.: US 9,322,612 B2
(45) Date of Patent: Apr. 26, 2016

(54) HOLSTER INCLUDING TRIGGER GUARD LOCK

(71) Applicant: Norman E. Clifton, Jr., Jacksonville, FL (US)

(72) Inventor: Norman E. Clifton, Jr., Jacksonville, FL (US)

(73) Assignee: Safariland, LLC, Jacksonville, FL (US)

( * ) Notice: Subject to any disclaimer, the term of this patent is extended or adjusted under 35 U.S.C. 154(b) by 43 days.

(21) Appl. No.: 14/203,316

(22) Filed: Mar. 10, 2014

(65) Prior Publication Data

US 2014/0291363 A1 Oct. 2, 2014

Related U.S. Application Data

(63) Continuation-in-part of application No. 29/451,372, filed on Apr. 1, 2013, now Pat. No. Des. 712,999.

(51) Int. Cl.
*F41C 33/02* (2006.01)

(52) U.S. Cl.
CPC ..... *F41C 33/0263* (2013.01)

(58) Field of Classification Search
CPC .. F41C 33/02; F41C 33/0263; F41C 33/0227; F41C 33/0272
See application file for complete search history.

(56) References Cited

U.S. PATENT DOCUMENTS

| | | | | | |
|---|---|---|---|---|---|
| 3,713,239 | A * | 1/1973 | Sperling | 42/70.07 |
| 3,866,811 | A * | 2/1975 | Hamby | 224/244 |
| 4,694,980 | A * | 9/1987 | Rogers | 224/243 |
| 5,100,036 | A * | 3/1992 | Rogers et al. | 224/244 |
| 5,449,103 | A * | 9/1995 | Tilley | 224/244 |
| 5,810,221 | A * | 9/1998 | Beletsky et al. | 224/244 |
| 5,927,578 | A * | 7/1999 | Kay | 224/244 |
| 5,944,239 | A * | 8/1999 | Rogers et al. | 224/193 |
| RE44,428 | E * | 8/2013 | Spielberger | 224/244 |
| 8,925,773 | B2 * | 1/2015 | Clifton | 224/243 |
| 2003/0075575 | A1 * | 4/2003 | Rogers et al. | 224/242 |
| 2011/0163138 | A1 * | 7/2011 | Tyybakinoja | 224/244 |
| 2011/0266317 | A1 * | 11/2011 | Clifton | 224/242 |
| 2013/0306691 | A1 * | 11/2013 | Baumann et al. | 224/244 |

* cited by examiner

*Primary Examiner* — Brian D Nash
(74) *Attorney, Agent, or Firm* — Arthur G. Yeager

(57) ABSTRACT

Trigger guard lock device for retaining a firearm in a holster and enabling unlocking and removing the handgun from the holster in a single motion. In an aspect, a trigger guard device comprises a device body having a channel for receiving a firearm trigger guard, a lock automatically locks upon insertion of the guard and is positioned within the channel for retaining the guard and a release lever to permit the lock to pivot. The release is positioned at the top rear of the holster such that the release is actuated by finger of a user during the natural withdrawal motion. In this manner, the user may unlock and remove the handgun in a single motion. Also, the device includes an adjustable stabilizer for the handgun.

20 Claims, 10 Drawing Sheets

HOLSTER INCLUDING TRIGGER GUARD LOCK

CROSS-REFERENCE TO RELATED APPLICATION

This application is a continuation-in-part of U.S. Design patent application Ser. No. 29/451,372, filed Apr. 1, 2013, and entitled "Holster Trigger Guard Locking Device," the entire contents of which are incorporated herein by reference.

FIELD OF THE DISCLOSURE

The present disclosure relates to holsters, and more particularly to quick release holsters including a lock that may be actuated during the drawing motion.

BACKGROUND

Prevention of unwanted or unauthorized withdrawal of a firearm from a holster is a significant concern. On the other hand, allowing rapid withdrawal and readying of the firearm by authorized users (e.g., law enforcement officers) is desired.

Basic holsters are known which consist of a leather or plastic material body which forms a holster pocket for removably accommodating a handgun. Such holsters allow the handgun to be removed in one motion, but often provide no defense against unauthorized withdrawal. Furthermore, the handgun may inadvertently fall out of such holster, which is most undesirable.

Other holsters are known, such as the safety holster device disclosed in U.S. Pat. No. 5,018,654 to Clifton et al., which comprise a holster pocket and a removable strap. The removable strap impedes the vertical movement of a handgun in the holster via contacting the rear of the handgun. The removable strap may be detached via attaching snaps positioned on a side of the holster. Such safety holsters provide defense against unauthorized withdrawal but require more than one motion to remove the handgun. That is, a user must first unsnap the removable strap and then slide the handgun out of the safety holster. The user must learn a new behavior to remove the handgun. During a high stress situation, the user may attempt to remove the handgun using the single motion associated with basic holsters (i.e., sliding the handgun out of the holster). This motion will not successfully remove the handgun from such safety holsters, delaying removal and potentially endangering the user.

Biometric holster devices, such as those disclosed in U.S. Pat. No. 6,918,519 to Keller et al. comprise a holster, a locking member, and a biometric sensor. The locking member locks a handgun inserted into the holster by, for example, impeding movement of the trigger guard, and is actuated by the biometric sensor. The biometric sensor is positioned adjacent the holster opening. A user presses a finger against the biometric sensor. The biometric sensor scans the finger, compares the scan to stored biometric information and, if there is a match, actuates the locking member, thereby releasing the handgun. Such biometric holster devices provide defense against unauthorized withdrawal but require more than one motion to remove the handgun. Furthermore, analysis of biometric data may take significant time, delaying the unlocking of the handgun by an authorized user.

Given the foregoing, what are needed are devices which securely retain a holstered handgun or other firearm and allow authorized users to unlock and remove the handgun in a single motion.

SUMMARY

This summary is provided to introduce a selection of concepts in a simplified form that are further described below in the Detailed Description. It is not intended to identify key features or essential features of the subject matter to be claimed, nor is it intended to be used to limit the scope of the subject matter to be claimed.

The present disclosure is directed to trigger guard lock devices which facilitate securely retaining handguns and other firearms within a holster. Devices in accordance with the present disclosure reduce risk of unauthorized removal via locking the handgun within the holster at the handgun trigger guard. A trigger guard release is positioned at the rear of the holster such that the release may be actuated by a user during the natural withdrawal motion. In this manner, the user may unlock and remove the handgun in a single motion.

In an aspect, a holster comprises a holster pocket for removably accommodating a firearm therein and a trigger guard lock device. The trigger guard lock device is positioned within the holster pocket and receives a firearm trigger guard. The lock device automatically engages the trigger guard when the firearm is inserted into the holster, thereby locking the firearm in place within the holster and reducing the risk of unauthorized or inadvertent removal of the firearm from the holster. The lock device comprises a trigger guard release positioned at the rear space adjacent the trigger guard portion and the open top of the holster for actuation by the user during a firearm release motion.

In an aspect, a trigger guard lock device includes a handgun receiver stabilizer assembly. The stabilizer assembly contacts the underside of the handgun receiver, preventing movement by adjustably pressing against the receiver. Some handguns include receivers made of hard plastic, which may deform, causing contact between the receiver stabilizer assembly and the receiver to become loose, thereby causing unwanted movement. In an aspect, the trigger guard lock devices comprises a receiver stabilizer assembly having a floating end portion which allows the stabilizer assembly to move more freely and release pressure which might otherwise cause the handgun receiver to deform and become loose. In this manner, the stabilizer assembly stays in tight contact with handguns equipped with plastic receivers.

Further features and advantages of the devices and systems disclosed herein, as well as the structure and operation of various aspects of the present disclosure, are described in detail below with reference to the accompanying figures.

BRIEF DESCRIPTION OF THE DRAWINGS

The features and advantages of the present disclosure will become more apparent from the Detailed Description set forth below when taken in conjunction with the drawings in which like reference numbers indicate identical or functionally similar elements.

DETAILED DESCRIPTION

The present disclosure is directed to trigger guard lock devices which facilitate securely retaining handguns and other firearms within a holster. Devices in accordance with the present disclosure reduce risk of unauthorized removal via locking the handgun within the holster at the handgun trigger guard.

Referring now to FIG. 1-3C, various views of a holster 106 having an integrated trigger guard lock device 100 for retaining a handgun 104, are shown and described in accordance with various aspects of the present disclosure.

Figure 14:
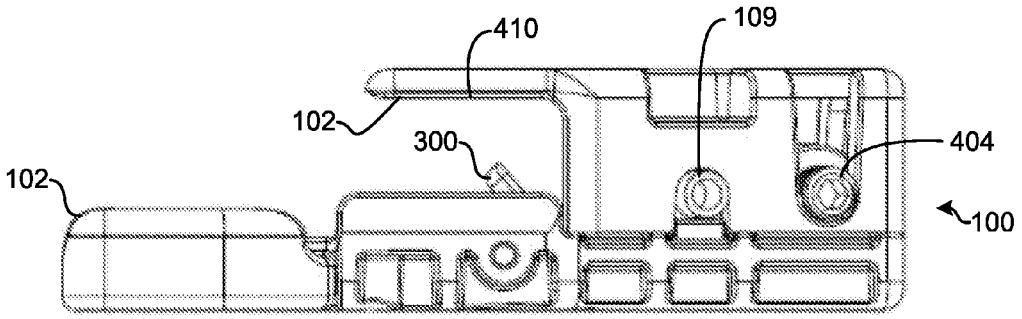
FIG. 14 is a bottom plan view of the trigger guard lock device of FIGS. 5A, 5B, the trigger guard lock being in an unlocked position for receiving a handgun trigger guard.
Figure 15:
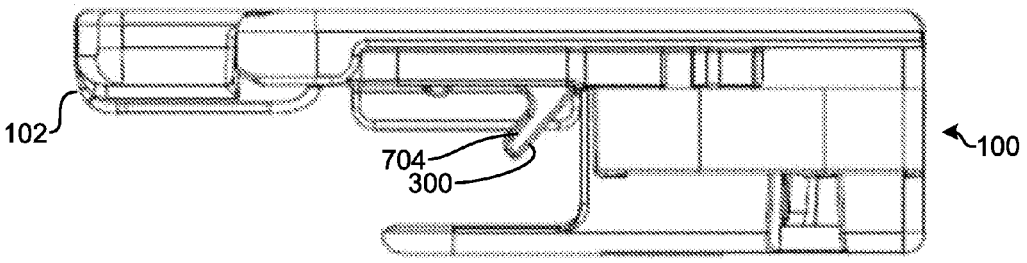
FIG. 15 is a top plan view of the trigger guard lock device of FIG. 14.
Figure 16:
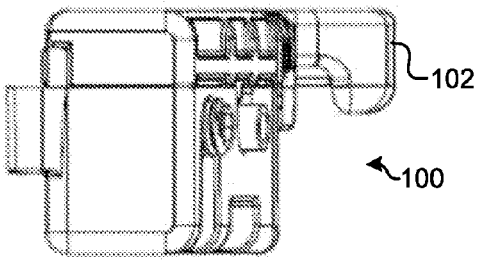
FIG. 16 is a right end view of the trigger guard lock device of FIG. 14.
Figure 17:
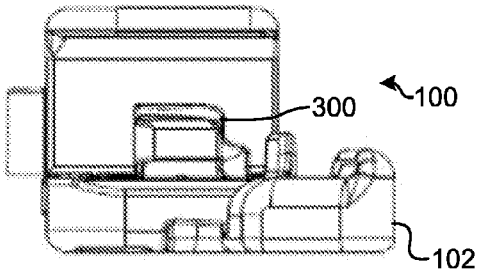
FIG. 17 is a left end of the trigger guard lock device of FIG. 14.
Figure 19:
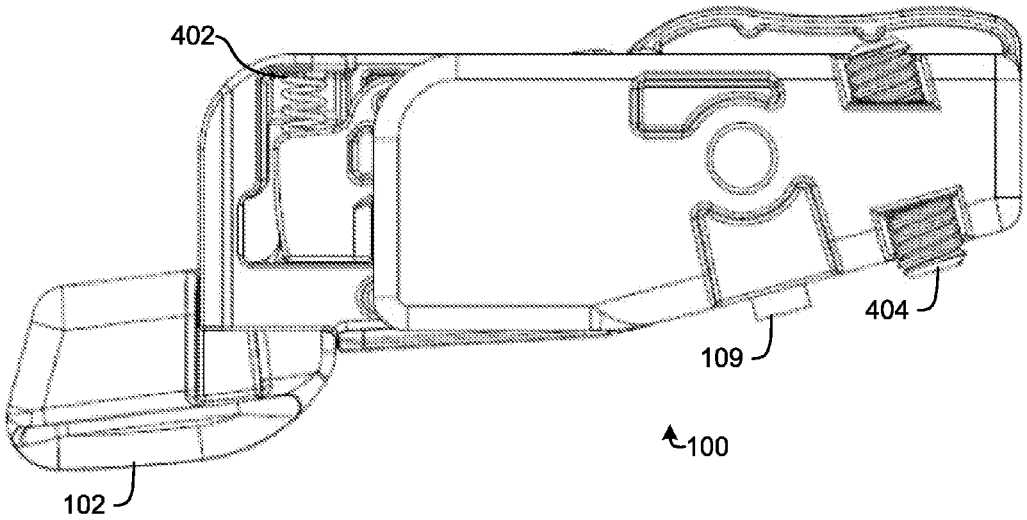
FIG. 19 is an inner side elevational view of the trigger guard lock device of FIG. 14.

Holster 106 comprises a holster pocket 108 for removably accommodating handgun 104 therein. Trigger guard lock device 100 is positioned and connected within holster pocket 108, for example, by screw 107 (see FIGS. 14 and 19) threaded into a weld nut or T-nut 109 extending outwardly from the device 100, which device 100 receives a handgun 104, including a trigger guard 112. Devices 100 may retain firearms or handguns having trigger guards including revolvers, pistols and the like.

Holster 106 may be removably attached to a belt, such as a law enforcement officer utility belt via a post 110 with a known clip 114 or a paddle or a hanger or a belt loop or the like positioned on an inner portion of holster 106.

Device 100 automatically engages trigger guard 112 when handgun 104 is inserted into device 100, thereby locking handgun 104 in place within holster 106. Device 100 comprises a trigger guard release 102 positioned at the open top and adjacent the rear of holster 106 for actuation by the user during a firearm release motion. Release 102 impedes the movement of lock 300. Actuation of release 102 by a forward force by the user on release 102 moves stop 500 (shown in greater detail in FIGS. 5-7), allowing lock 300 to pivot and free or release trigger guard 112 so that handgun 104 may be drawn. Handgun 104 is then removed from device 100 and holster 106. Release 102 is positioned rearward adjacent to the handgun grip 116, enabling release 102 to be actuated as the user grabs handgun 104 during the release and withdrawal motion. Release 102 is actuated by pushing release 102 toward the insertion axis of handgun 104.

Referring now to FIGS. 3A-C to FIG. 9, perspective views of portions of trigger guard device 100 and device 100 as a whole are shown and described in accordance with various aspects of the present disclosure.

Figure 4B:
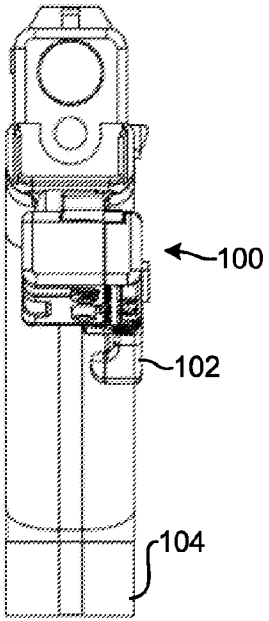
FIGS. 4A-4C are various views of the trigger guard lock device in locking position on a handgun trigger guard.
Figure 4A:
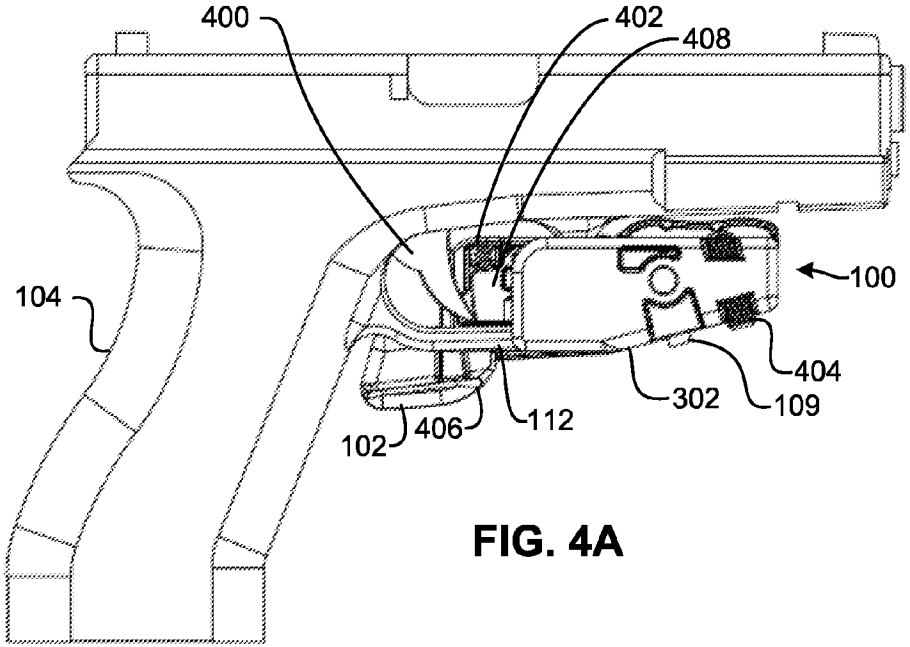
Figure 4C:
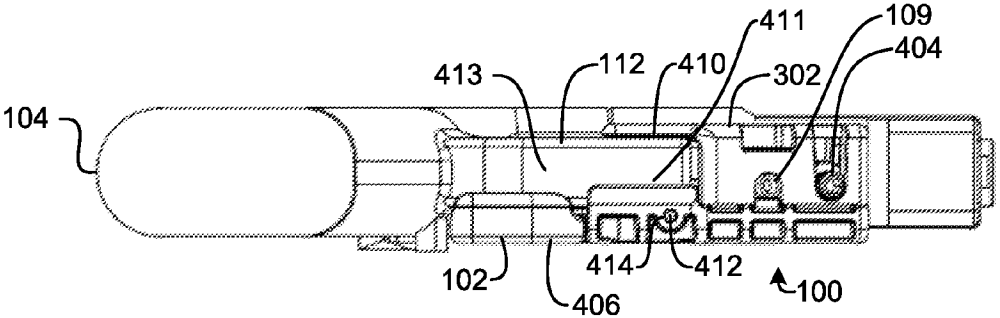

As shown in FIGS. 4A-C, release 102 preferably includes a sloped lower portion 406, enabling a user to slide a finger up along a rear portion of holster 106 to contact release 102 in order to actuate release 102, enabling a natural gripping motion by the wearer of holster 106 to release handgun 104 during a drawing motion.

Figure 1:
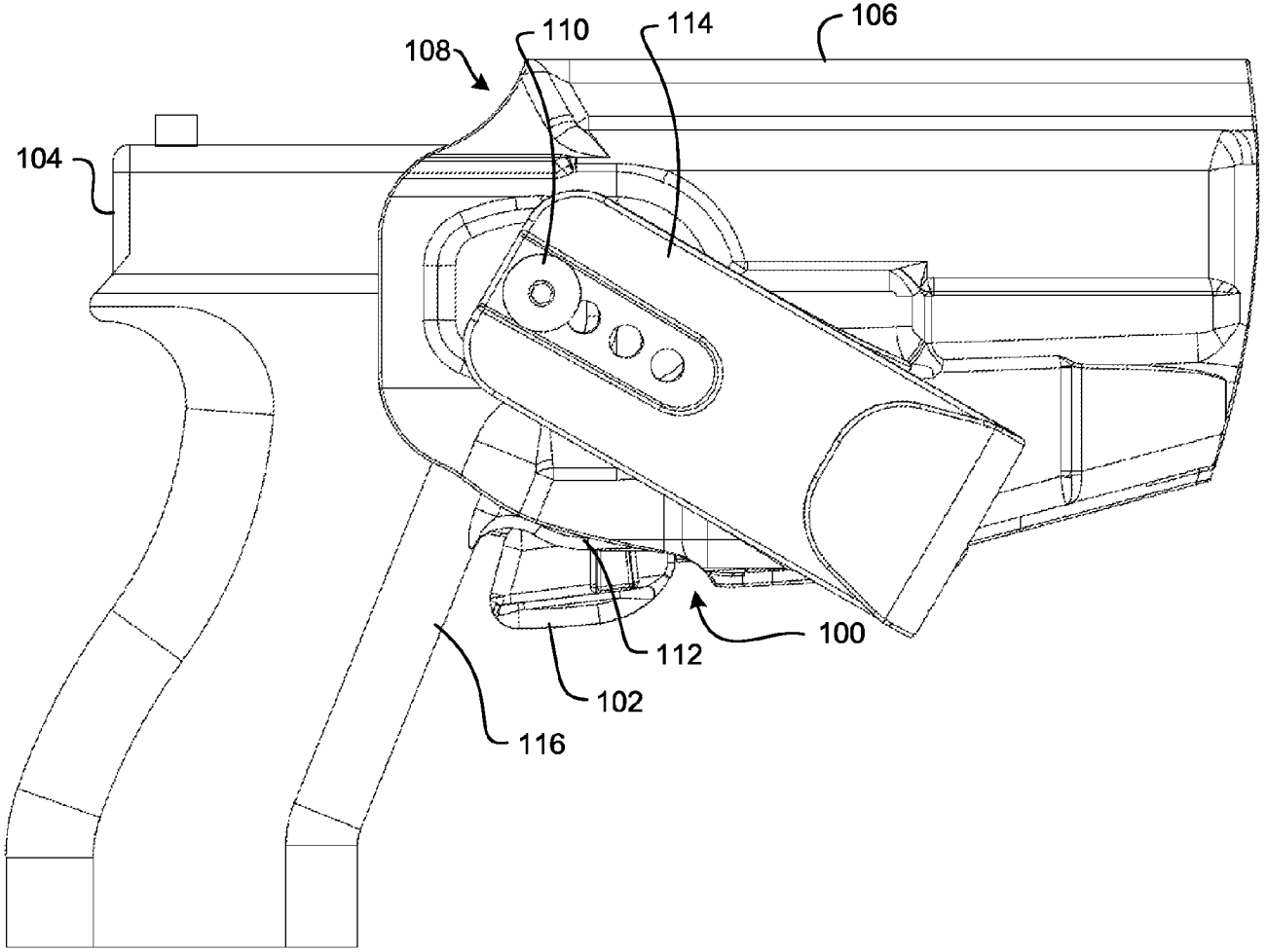
FIG. 1 is an inner side elevational view of a holster including a trigger guard lock device wherein the holster retains a handgun, in accordance with an aspect of the present disclosure.
Figure 2:
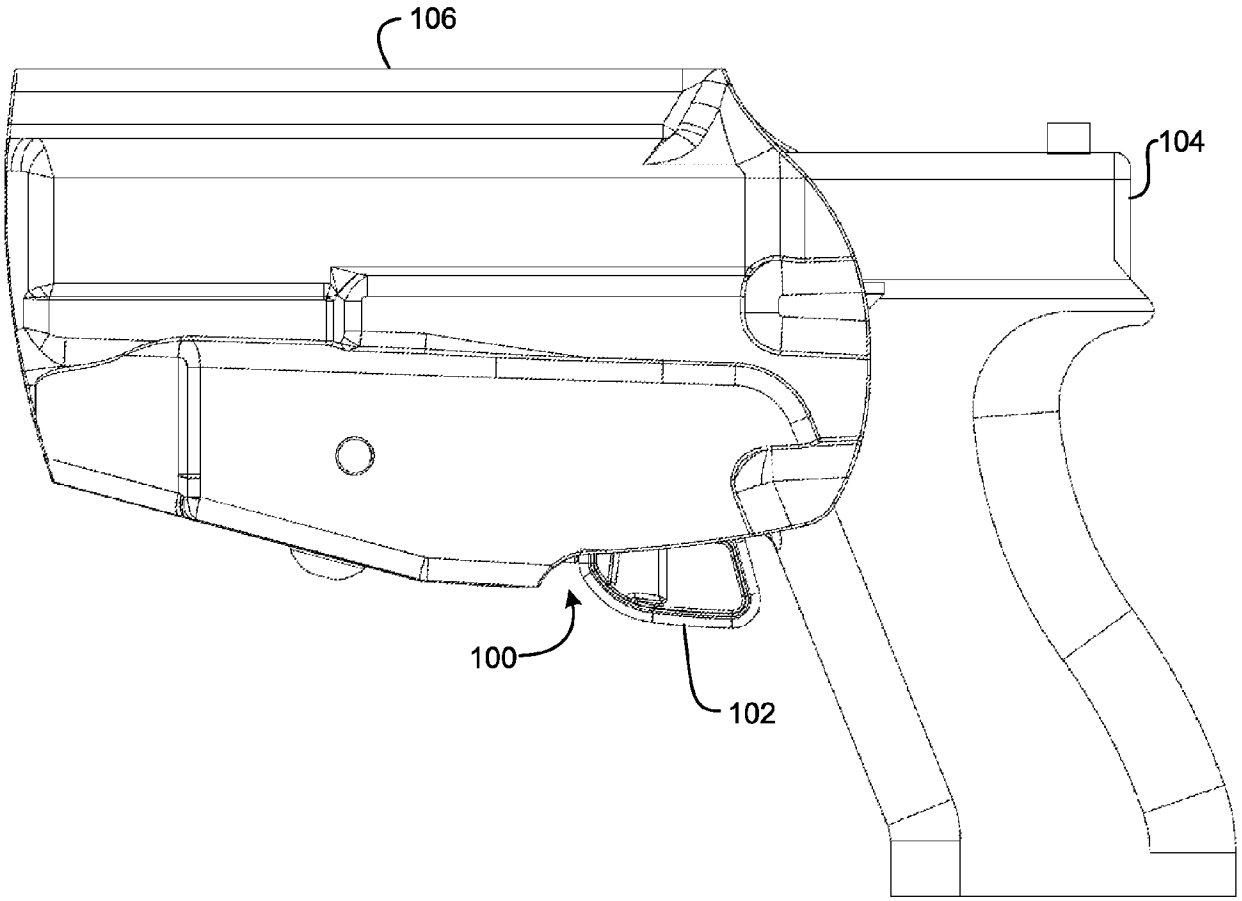
FIG. 2 is an outer side elevational view of the holster of FIG. 1.
Figure 3A:
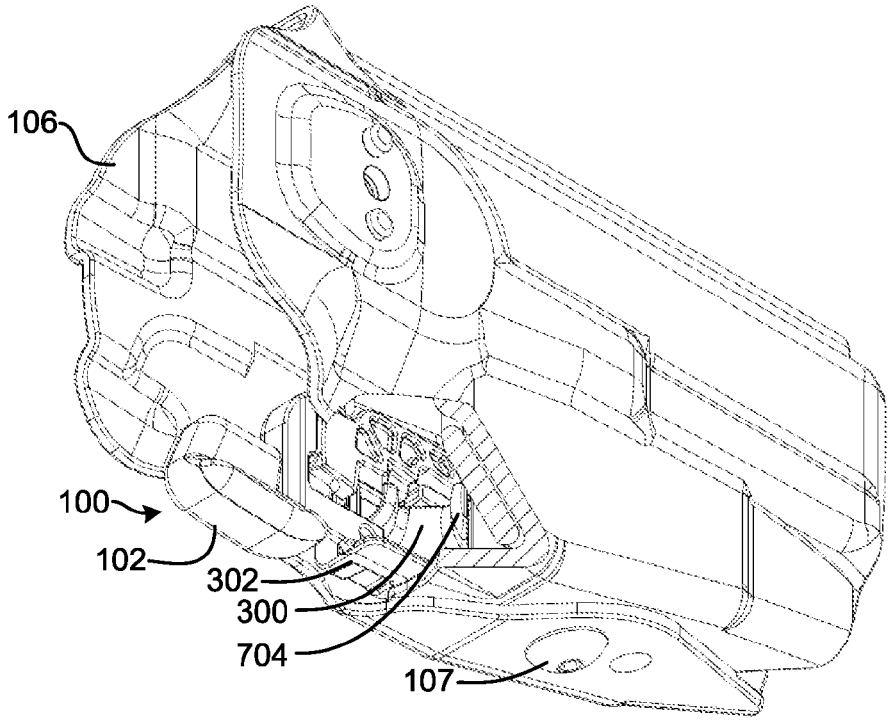
FIG. 3A is a top back perspective view of the holster of FIG. 1 without the handgun and partly cut away.
Figure 3B:
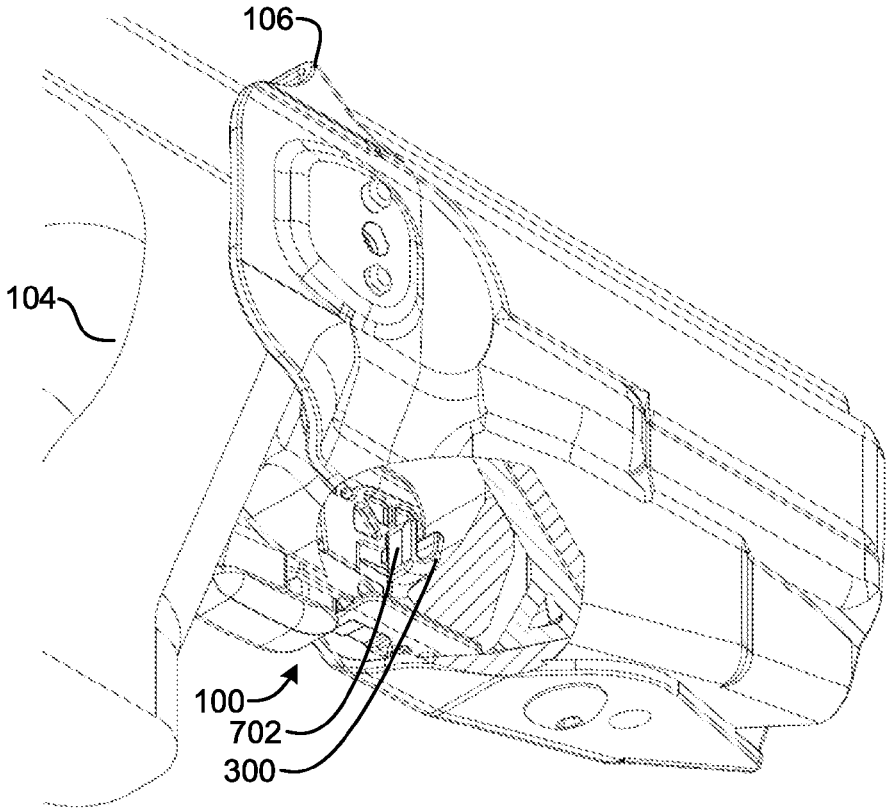
FIG. 3B is a similar view of FIG. 3 with the handgun in the holster.
Figure 5A:
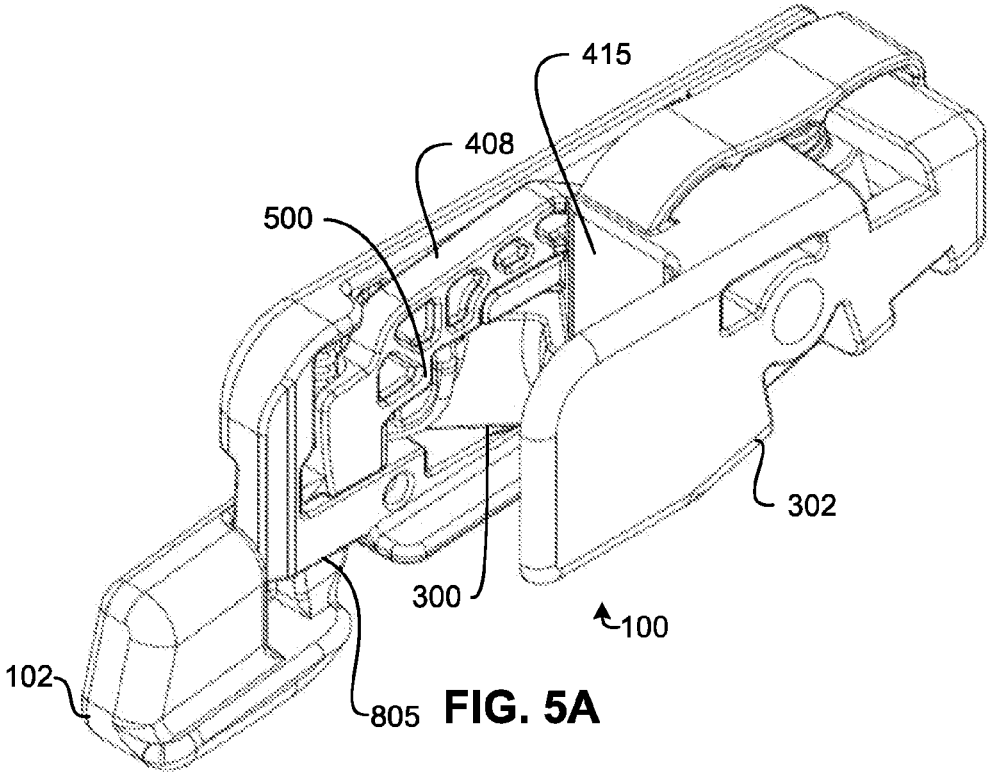
FIGS. 5A & 5B are perspective views of the trigger guard lock device respectively showing the lock in the disengaged and engaged positions.
Figure 5B:
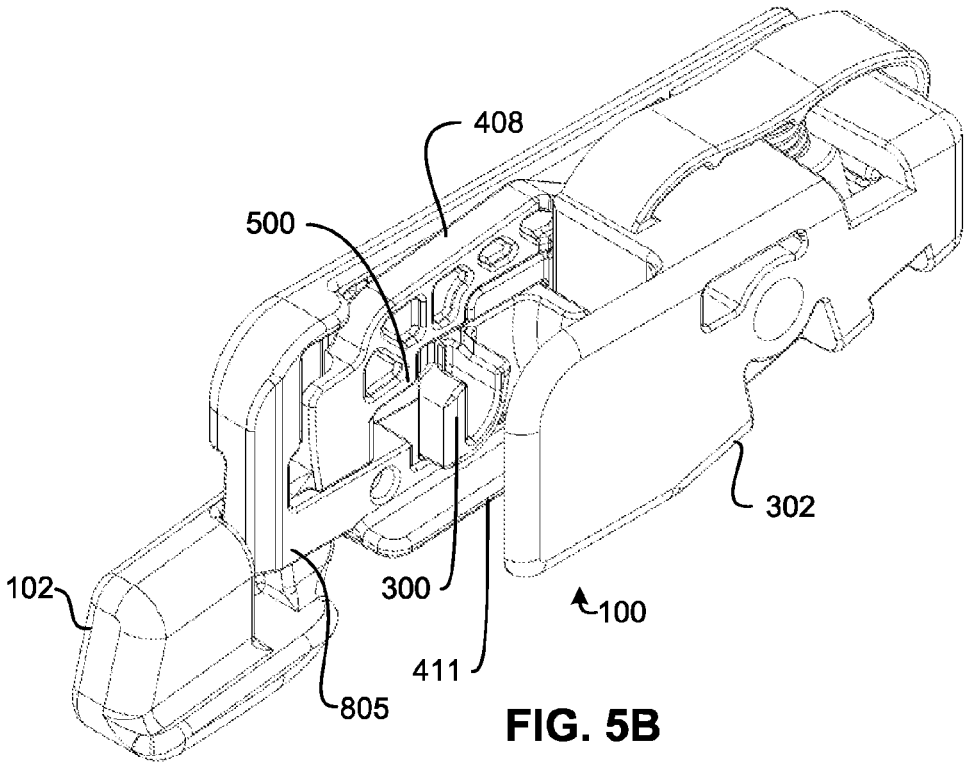
Figure 6:
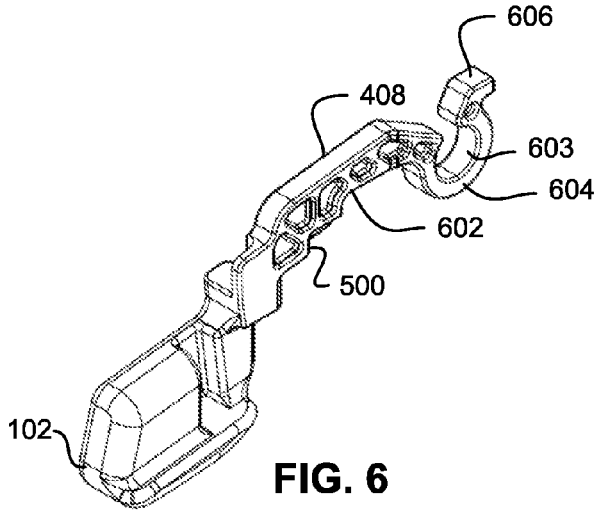
FIG. 6 is a perspective view of a locking arm of the trigger guard lock device.
Figure 7:
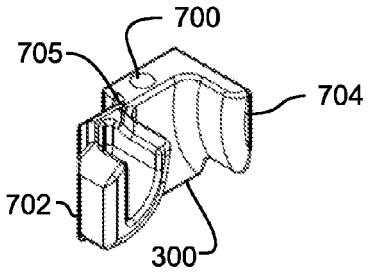
FIG. 7 is a perspective view of a trigger guard lock of the trigger guard lock device.
Figure 18:
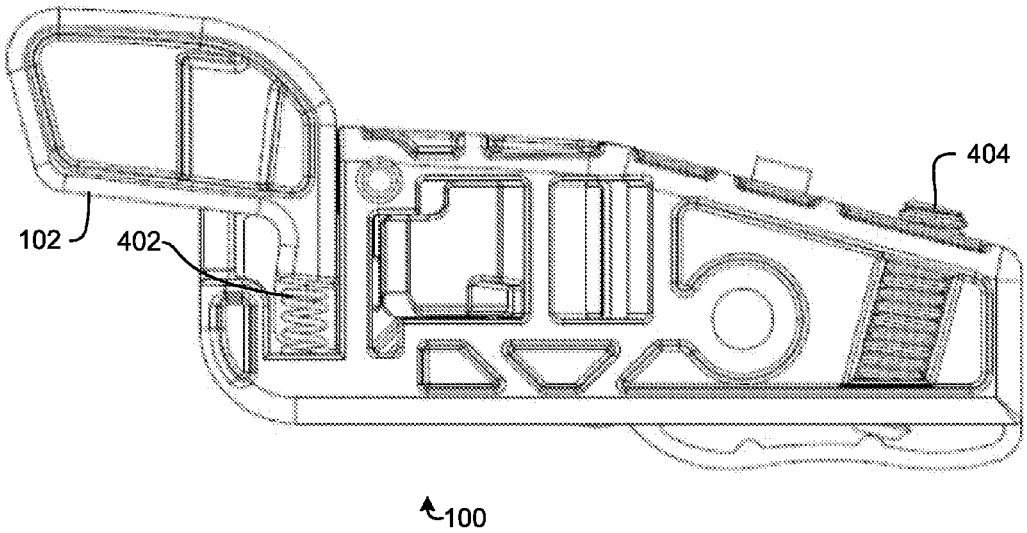
FIG. 18 is an outer side elevational view of the trigger guard lock device of FIG. 14.

A release lever assembly 408, shown in FIG. 6, includes release 102 and a stop 500. At its forward end portion 604, release lever assembly 408 is pivotally connected to body 302 between two positions, a release position and a lock position. As discussed in greater detail below, in the lock position, release lever assembly 408 inhibits pivoting of lock 300 via stop 500. A backup spring 402, shown in FIGS. 18, 19 exerts a force against release lever assembly 408 maintaining release lever 408 in the lock position when handgun 104 has been inserted into device 100 until a user actuates release 102. As shown in FIGS. 3B and 5B, in the release position, release lever 408 is moved inwardly, allowing lock 300 to pivot open about its pivot axis which is orthogonal to the insertion axis of the handgun and the holster. This pivoting of lock 300 does not contact or interfere with the firearm trigger 400 at any position of the lock 300.

Device 100 preferably accommodates trigger guard 112 at trigger guard channel 410. Channel 410 is generally U-shaped and formed by base 415 and two opposed side panels 800 and 900, hereinafter more fully described, and such channel 410 correctly aligns the trigger guard 112 and prevents lateral movement of trigger guard 112, when locking handgun 104 into device 100 or withdrawal of the handgun 104 from the channel 410 and the holster. In an aspect, channel 410 may be omitted and lateral movement of handgun 104 and trigger guard 112 may be formed by and within the holster 106. A rearward wall 411 extends laterally from one of the side panels 800, 900 on which a lower surface 413 of the trigger guard 112 slides as the handgun is inserted into or drawn from the holster and with the channel 410 accurately positions the handgun to be locked into the holster.

Figure 12:
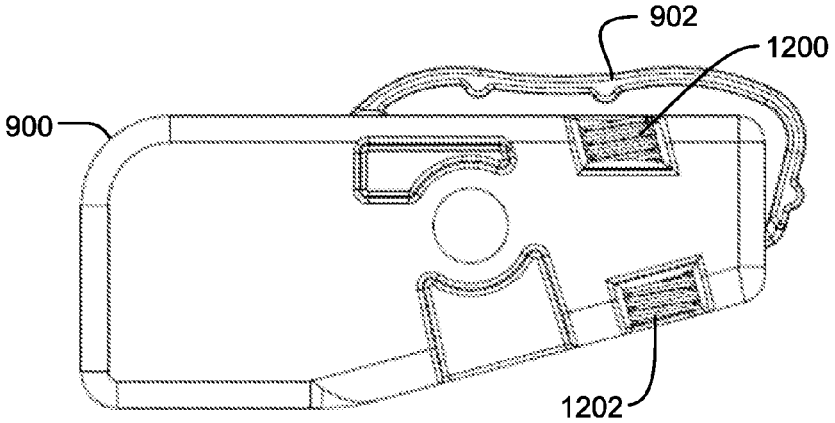
FIG. 12 is an outer side elevational view of the guide panel of FIG. 9.
Figure 13:
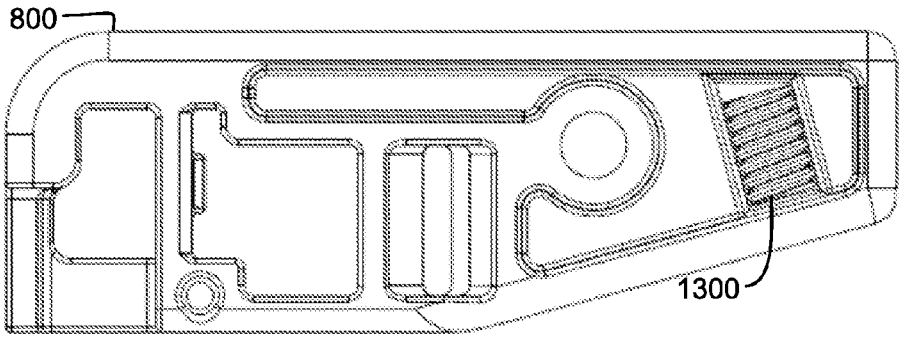
FIG. 13 is an inner side elevational view of the locking panel of FIG. 8.

Portions of device 100 are held together via one or more screws, including screw 404 being threaded through mating half threads 1200, 1202 and 1300 (see FIGS. 12, 13).

Figure 8:
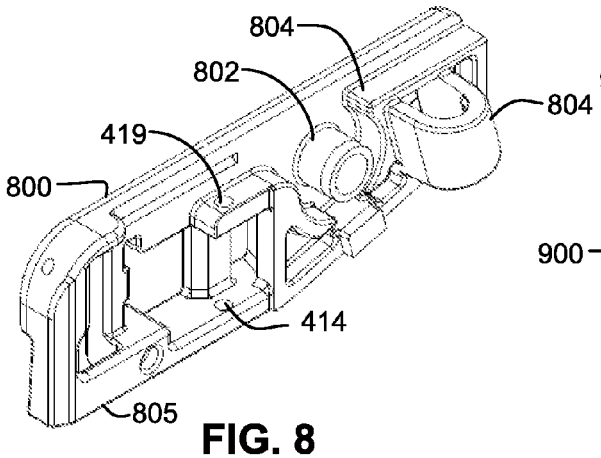
FIG. 8 is a perspective view of a locking panel of the trigger guard device body.
Figure 9:
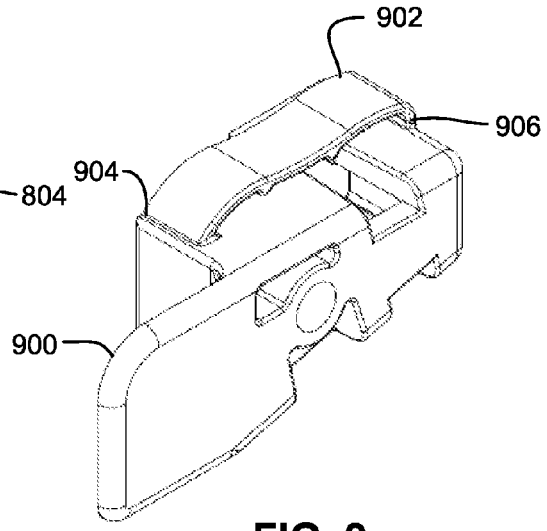
FIG. 9 is a perspective view of a mating guide panel of the trigger guard device body.
Figure 10:
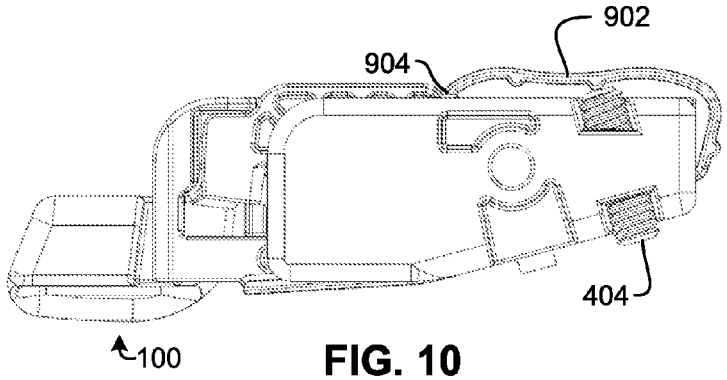
FIG. 10 is an inner side view of a trigger guard device having a floating receiver stabilizer assembly.
Figure 11:
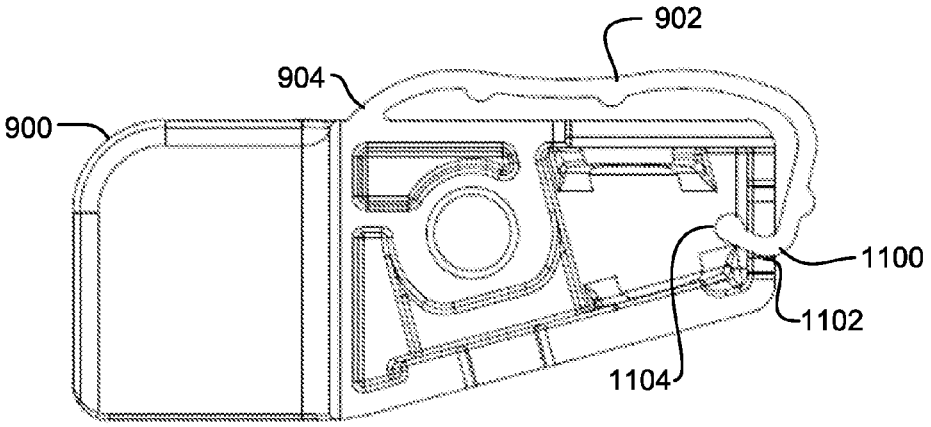
FIG. 11 is an inner side elevational view of the guide panel of FIG. 9.

Lock 300 is a rigid, angled member connecting to a device body 302 via pin 412 forming its pivot axis extending generally perpendicular or orthogonal to the insertion axis, and is shown in FIG. 4C. Pin 412 is inserted into a first body channel 414, a lock channel 700 and a second body channel 419 (see FIGS. 7,8). Lock 300 is pivotable about pin 412 between an engaged position (FIG. 3B) and a disengaged position (FIG. 3A). In the engaged position, lock 300 retains handgun 104 by engaging trigger guard 112. In the disengaged position, handgun 104 may be readily removed or inserted. In the disengaged position, a lock front portion 704 protrudes into the insertion path of handgun 104. As handgun 104 is inserted into device 100, trigger guard 112 contacts lock front portion 704, causing lock rear portion 704 to pivot into the engaged position. In the engaged position, lock rear portion 702 pivots and protrudes within the trigger guard and above the lower leg of the trigger guard 112, at least partially and effectively blocking any motion of trigger guard 112 and locking handgun 104 into device 100. In the engaged position, lock front portion 704 is held in place by contact with a stop 500. When release lever 408 is in the lock position (shown in FIGS. 1-3), stop 500 physically contacts lock 300 at lock rear portion 702, thereby retaining lock 300 in the engaged position (FIG. 5B). As shown in FIG. 5A, stop 500 rests on top of lock 300 at rear lock portion 702 when lock is in the disengaged position.

Figure 3C:
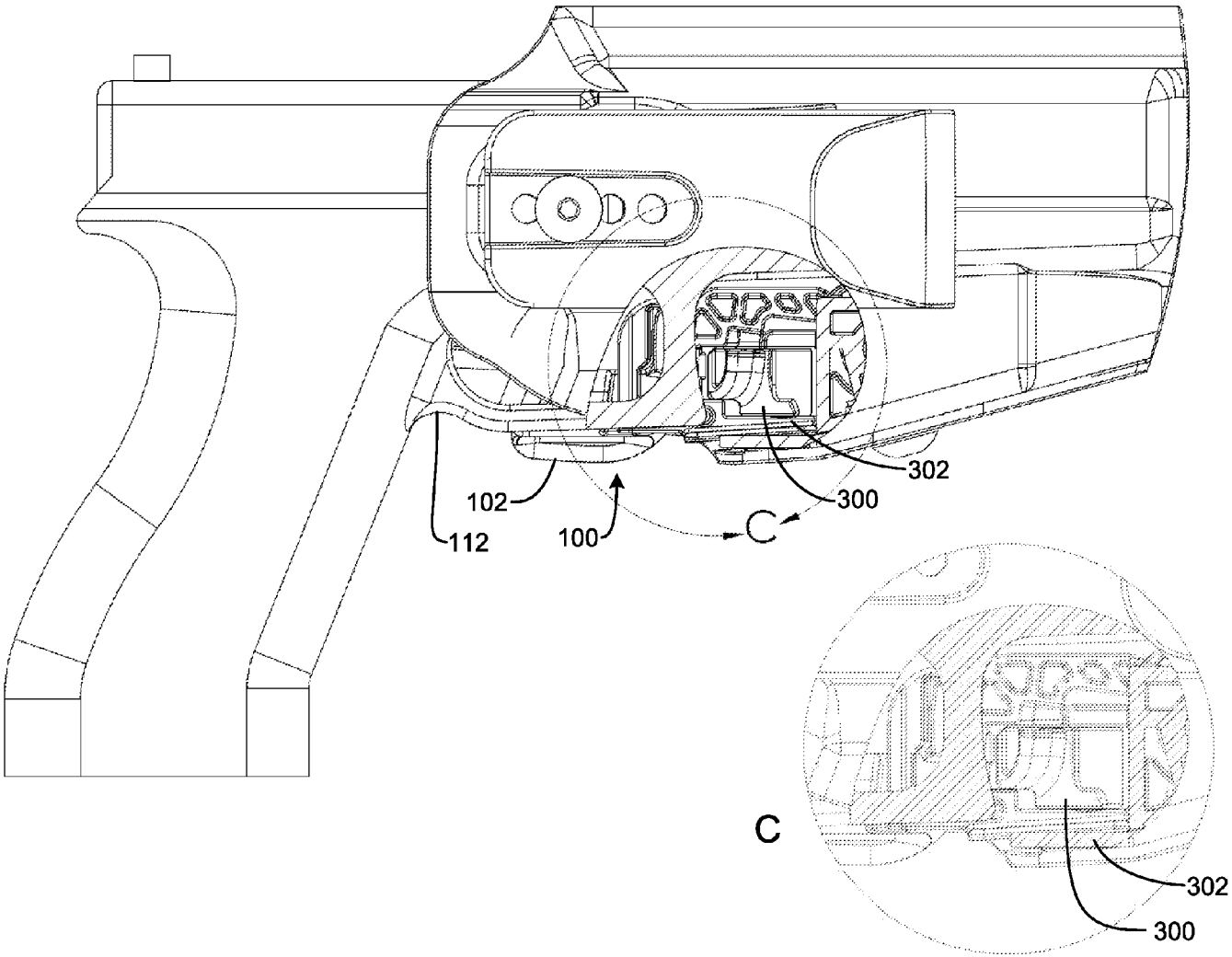
FIG. 3C is a similar view to FIG. 3B with the handgun partially withdrawn.

FIG. 3C depicts an enlarged detail cutaway view of region C. Lock 300 remains in the engaged position, as shown, by handgun 104 being inserted into device 100 and contacts lock 300 at lock front portion 704. It is immaterial if release 102 is held or not held in an inward position to cause the lock 300 to pivot, since the force exerted by the handgun being holstered forces the release lever 408 to pivot inwardly by ramp 705 of lock 300 moving lever 408 so that the lock 300 becomes engaged with the trigger guard 112. Thus, lock front portion 704 does not obstruct the insertion path of handgun 104 but provides an automatic feature that the lock 300 will engage the trigger guard 112 and be locked when the release 102 flexes back to its normal position, with or without backup spring 402.

Body 302 advantageously includes locking panel 800 and guide panel 900. Locking panel 800 and guide panel 900 are connected via screw 404. Screw 404 is threaded into guide panel channel 1202 and then into channel 804 of locking panel 800 and then back into guide panel channel 1200 (shown in FIGS. 12, 13). Release lever assembly 408 is pivotally connected to locking panel 800 at a cylindrical boss 802 which receives complemental arcuate portion 603 of lever 408 therearound. Lever anchor 604 pivots around boss 802. The movement of release lever assembly 408 is limited by contact between lever stop 606 and locking panel stop 804, thereby assisting in controlling the maximum inward or upward actuation of release 102 by a user which is also limited by release lever 102 contacting stop 805. Advantageously, release lever assembly 408 is configured such that failure of release lever assembly 408 (e.g., snapping) along lever arm 602, at lever anchor 604, for example, or lever stop 606 does not impede movement of stop 500, to allow lock 300 to pivot and facilitate the withdrawal of handgun 104 even where a portion of release lever assembly 408 has failed. The release lever assembly 408, best shown in FIG. 6, is a rigid member that is flexed and bent, so that when positioned onto boss 802 (FIG. 8) via arcuate portion 603, the release 102 is biased into the outward position depicted herein.

Guide panel 900 includes handgun receiver stabilizer assembly 902. Stabilizer assembly 902, a curved, rigid but bendable member, exerts a spring force against a handgun receiver in order to stabilize the handgun 104 within trigger guard lock device 100 on an attached holster 106. Screw 404 contacts a lower portion of stabilizer assembly 902 and adjusts the inward position of stabilizer assembly 902, allowing a user to tighten stabilizer assembly against the handgun receiver. Stabilizer assembly 902 is rigidly molded to and connected to guide panel 900 at a rear stabilizer connection 904 and a front stabilizer connection 906.

Referring now to FIGS. 10-13, various views of trigger guard lock device 100 are shown and described detailing configurations of a stabilizer assembly 902.

In another aspect, stabilizer assembly 902 is rigidly connected to guide panel 900 at a rear stabilizer connection 906. A lower stabilizer portion 1100 is a curved, floating member having a flared end portion 1104. Front stabilizer portion 1100 is inserted into guide panel 900 at slot 1102, creating an adjustable spring via screw 404. In this manner, a floating end portion is created which allows stabilizer assembly 902 to move more freely and release pressure which might otherwise cause some handgun receivers, often made from plastic materials, to deform and become loose and requiring screw 404 to be adjusted from outside of the holster. Sometimes the handgun is too loose requiring the screw 404 to move inwardly to tighten belt 902 against the handgun.

Locking panel 800 includes locking panel half threads 1300. Guide panel 900 includes upper guide half threads 1200 and lower guide half threads 1202. Locking panel half threads 1300, upper guide half threads 1200 and lower guide half threads 1202 cooperate to receive screw 404 and to interconnect locking panel 800 and guide panel 900.

Referring now to FIGS. 14-19, various views of trigger guard lock device 100 are shown with lock 300 in the disengaged position, in accordance with an aspect of the present disclosure.

Channel 410 is preferably formed by two rigid portions of body 302 spaced apart a distance approximately equal to the width of trigger guard 112 and a rearward wall 411 on one of the two rigid inwardly extending portions of body 302. In an aspect, lock 300 protrudes into channel 410 at least half the width of channel 410 when lock 300 is in the disengaged position.

While various aspects of the present disclosure have been described above, it should be understood that they have been presented by way of example and not limitation. It will be apparent to persons skilled in the relevant art(s) that various changes in form and detail can be made without departing from the spirit and scope of the present disclosure. The present disclosure should not be limited by any of the above described aspects, but should be defined only in accordance with the following claims and their equivalents.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present invention in any manner.

What is claimed is:

1. A locking holster assembly for a handgun, the holster assembly comprising a holster pocket for removably accommodating a handgun therein, the holster pocket generally surrounding an elongated insertion axis of the holster for receiving a handgun, a trigger guard lock device connected to and in the holster pocket for automatically engaging a trigger guard of a handgun upon insertion into the holster pocket and selectively operable to allow subsequent withdrawal of a handgun, the locking device including a lock for removably accommodating a trigger guard of a handgun therein, the lock being operable between a disengaged position and an engaged position which inhibits movement of a trigger guard in the holster, and a release lever assembly including a stop and a release, the release being selectively operable to allow movement of the lock between the engaged position and the disengaged position, the release being positioned adjacent a top open portion and rear of the holster and adjacently below and generally aligned with a trigger guard of a handgun when disposed in the holster.

2. The locking holster assembly of claim 1, wherein the stop physically contacts the lock for preventing movement of the lock in the engaged position until the release moves the stop out of engagement with the lock to the disengaged position to allow withdrawal of a handgun holsterable in the holster.

3. The locking holster assembly of claim 1, further including at least one post positioned on an inner holster side portion for removable attachment to a user belt.

4. The locking holster assembly of claim 1, wherein the lock device further includes an inner panel portion and an outer panel portion being generally parallel and spaced apart, and forming a channel for receiving a downward portion of a trigger guard, and an elongate support member extends inwardly from one of the panel portions into the channel, the support member slidably receives a trigger guard lower portion and, when the lock is in the engaged position blocking substantial movement of the trigger guard in a direction parallel to the insertion axis.

5. The locking holster assembly of claim 4, wherein the channel is a U-shaped channel and with the support member positions a trigger guard to enable the lock to be engageable therewith forward of a trigger of a handgun constrains substantial movement of a trigger guard in a direction orthogonal to the insertion axis.

6. The locking holster assembly of claim 5, wherein the lock is generally L-shaped and has a leg extending into the channel and engageable by a front portion of a trigger guard to cause the lock to pivot on an orthogonal axis to the insertion axis causing another leg of the lock to be disposed above and between a trigger and a front portion of a trigger guard to lock a handgun in the holster.

7. The locking holster assembly of claim 1, wherein the release is positioned closely adjacent to a handgun grip when a handgun is inserted into the holster pocket and remote from a forward portion of a trigger guard.

8. The locking holster assembly of claim 1, wherein the trigger guard lock device further includes an adjustable handgun receiver stabilizer assembly for contacting a handgun receiver and stabilizing same within the holster pocket, the stabilizer assembly being adjustable to adjust contact with a handgun holsterable in the holster by an elongated set screw.

9. The locking holster assembly of claim 8, wherein the trigger guard lock device includes an elongate body having opposed ends with the release being adjacent an upper of the opposed ends and the stabilizer assembly being adjacent a lower of the opposed ends, the stabilizer assembly includes a floating band portion having a flared end portion contained within the device body, the set screw engaging the band which contacts a handgun receiver when disposed in the holster.

10. The locking holster assembly of claim 9, wherein the trigger guard lock device body includes a locking panel having a locking panel half threads, a guide panel having an upper guide half threads and a lower guide half threads, the locking panel and the guide panel being connected together by the set screw threaded at the lower guide half threads, the locking panel half threads and then the upper guide half threads and extending therefrom to contact the band.

11. A locking holster assembly for a handgun, the holster assembly comprising a holster pocket for removably accommodating a handgun therein, the holster pocket generally surrounding an elongated insertion axis of the holster for receiving a handgun and generally conforming to a handgun outer profile, and a trigger guard lock device connected to and in the holster pocket at a top open end and at a rear of the holster pocket for automatically engaging a handgun at a handgun trigger guard upon insertion into the holster pocket and selectively operable to allow subsequent withdrawal of a handgun, the locking device including:

a lock for removably accommodating a trigger guard of a handgun therein, the lock being operable between an engaged position locking a trigger guard and a disengaged position permitting movement of a trigger guard, a release lever including a stop and a release, the release being selectively operable to allow movement of the lock between the engaged position and the disengaged position, the release being positioned at an open top and rearwardly of the holster pocket, and an adjustable handgun receiver stabilizer assembly located remote from said trigger guard lock device for contacting a handgun receiver and stabilizing positioning of a handgun receiver within the holster pocket when locked therein.

12. The locking holster assembly of claim 11, the lock including a first panel portion and a second panel portion being generally parallel and spaced apart and a base on one of the panels forming a channel for receiving a forward portion of a trigger guard, and an elongate support member extends inwardly from one of the first and second panel portions on which a trigger guard lower portion is slideable, and when the lock is in the engaged position inhibiting substantial movement of a trigger guard in a direction parallel to the axis of insertion.

13. The locking holster assembly of claim 11, the trigger guard lock device further includes a U-shaped channel receiving a portion of a trigger guard and a elongate support extending into the channel that inhibits movement of a trigger guard in a direction orthogonal to the insertion axis.

14. The locking holster assembly of claim 13, wherein the lock is generally L-shaped and has a leg extending into the channel and engageable by a front portion of a trigger guard to cause the lock to pivot on an axis orthogonal to the insertion axis causing another leg of the lock to move blockingly behind a front portion in the engaged position of a trigger guard to lock a handgun in the holster.

15. The locking holster assembly of claim 11, wherein the release is positioned adjacent to a handgun grip when a handgun is inserted into the holster pocket so the release may be actuated with a finger of the user upon simultaneous withdrawal of a handgun by gripping a handgun grip.

16. A trigger guard lock device for selectively retaining a handgun in a holster, the trigger guard lock device comprising a device body having a channel removably receiving a trigger guard and inhibiting movement of a trigger guard in a direction orthogonal to a trigger guard insertion axis, a lock within the channel for selectively retaining a trigger guard and constraining movement of a trigger guard in a direction parallel to the trigger guard insertion axis, and a release lever positioned within the body including a stop and a release, the release being selectively operable to allow pivotal movement of the lock into a disengaged position, the release being positioned closely adjacent to a handgun grip of a handgun and remote from a forward portion of a trigger guard when the device body receives a trigger guard of a handgun, the release having a sloped lower portion for actuation by a finger of a user withdrawing a handgun from a holster.

17. The trigger guard lock device of claim 16, wherein the trigger guard lock device is positioned within and connected to a holster at an inner top rear holster portion forward of a trigger guard of a handgun.

18. The trigger guard lock device of claim 16, wherein the lock device includes a front panel portion and a rear panel portion being generally parallel and spaced apart, and forming a channel for receiving a forward portion of a trigger guard.

19. The trigger guard lock device of claim 16, wherein the lock is connected for pivoting to the body via a pin, the lock being shaped to have a pair of legs extending generally at a right angle with the pin being orthogonal to the insertion axis, one of the legs engaging a trigger guard when in an engaged position and another of the legs being engageable by a trigger guard front portion when inserted into the device body causing pivoting of the lock into the engaged position.

20. The trigger guard lock device of claim 16, further including an adjustable handgun receiver stabilizer assembly for contacting a handgun receiver and stabilizing positioning of a handgun receiver within a pocket of a holster, the stabilizer assembly being adjustable via a set screw adjustable through an opening at a rear of a holster.

* * * * *